United States Patent [19]

Brooks et al.

[11] Patent Number: 4,545,339

[45] Date of Patent: Oct. 8, 1985

[54] GLOW PLUG HAVING A CONDUCTIVE FILM HEATER

[75] Inventors: Mark A. Brooks, Sterling Heights; Ambrose Tomala, Royal Oak; Gary L. Casey, Troy, all of Mich.

[73] Assignee: Allied Corporation, N.Y.

[21] Appl. No.: 430,909

[22] Filed: Sep. 30, 1982

[51] Int. Cl.[4] ..... F02P 9/08; F23Q 7/22

[52] U.S. Cl. ..... 123/145 A; 219/205; 219/270; 361/266

[58] Field of Search ..... 123/145 A, 145 R; 219/205, 267, 270, 553; 361/264, 265, 266

[56] References Cited

U.S. PATENT DOCUMENTS

| | | | |
|---|---|---|---|
| 1,957,762 | 5/1934 | Dorner | 123/145 A |
| 2,178,659 | 11/1939 | White | 123/145 A |
| 2,198,850 | 4/1940 | White | 123/145 A |
| 2,993,977 | 7/1961 | Balaguer | 219/32 |
| 3,372,305 | 3/1968 | Mikulec | 317/98 |
| 3,553,833 | 1/1971 | Jochim et al. | 29/611 |
| 3,842,319 | 10/1974 | Peri | 317/98 |
| 4,035,613 | 7/1977 | Sagawa et al. | 219/552 |
| 4,160,969 | 7/1979 | Holmes | 338/23 |
| 4,183,136 | 1/1980 | Colla | 29/620 |
| 4,237,843 | 12/1980 | Page et al. | 123/145 A |
| 4,268,954 | 5/1981 | Sease et al. | 29/620 |
| 4,322,604 | 3/1982 | Kawamura et al. | 219/497 |
| 4,345,142 | 8/1982 | Dietz | 219/390 |
| 4,345,555 | 8/1982 | Oshima et al. | 123/272 |
| 4,351,291 | 9/1982 | Mahaney | 123/145 A |
| 4,357,526 | 11/1982 | Yamamoto et al. | 219/544 |
| 4,359,977 | 11/1982 | Sperner et al. | 123/145 A |
| 4,418,661 | 12/1983 | Esper et al. | 123/145 R |
| 4,437,440 | 3/1984 | Suzuki et al. | 123/145 A |

FOREIGN PATENT DOCUMENTS

| | | | |
|---|---|---|---|
| 2398969 | 3/1979 | France | 219/270 |
| 1094522 | 12/1967 | United Kingdom . | |

*Primary Examiner*—Parshotam S. Lall
*Assistant Examiner*—W. R. Wolfe
*Attorney, Agent, or Firm*—James R. Ignatowski; Russel C. Wells

[57] ABSTRACT

A glow plug for a compression ignited or Diesel engine having a base member, an axial electrode and a heater member. The heater member comprising a conductive surface film heater element disposed on the surface of a dielectric substrate. The surface film heater element having one end in electrical contact with the base member and the other end in electrical contact with the axial electrode.

39 Claims, 16 Drawing Figures

Fig-6
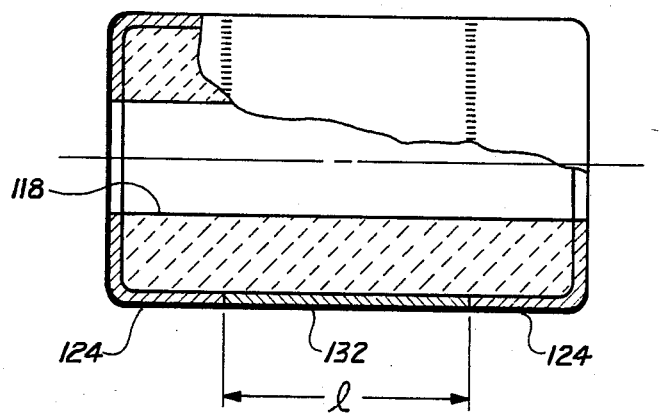
Fig-10
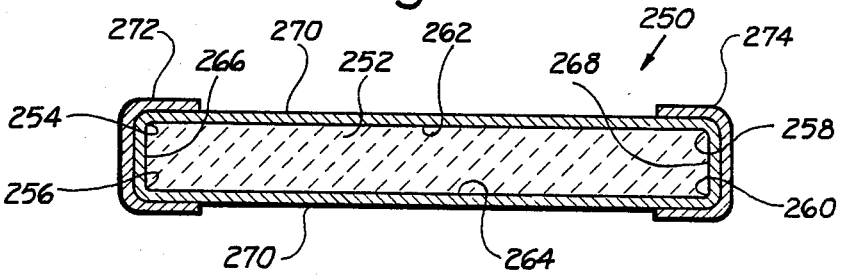
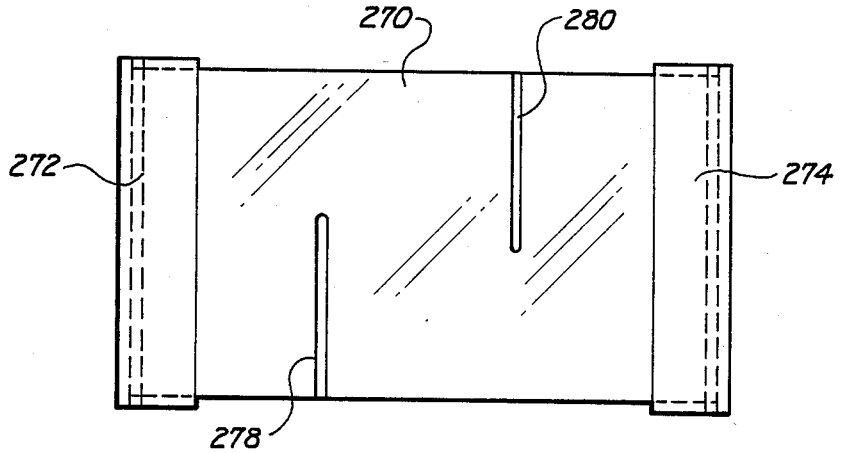
Fig-11

GLOW PLUG HAVING A CONDUCTIVE FILM HEATER

BACKGROUND OF THE INVENTION

1. Field of the Invention

The invention is related to the field of electric heaters and in particular to a glow plug having a conductive film heater for assisting the start ignition of a Diesel type engine.

2. Prior Art

Electrically energized glow plugs are currently used in compression ignited or Diesel type engines to assist in the ignition of the air/fuel mixture during cold starts. In particular glow plugs are essential in the northern states during the winter months when the ambient temperature falls below 10° C. The function of the glow plug is to heat the air/fuel mixture to a temperature which will cause spontaneous combustion when compressed in the engine's cylinders. After the engine has started, the heat developed by the combustion of the air/fuel mixture will maintain the combustion chamber at a temperature sufficient to sustain continued operation of the engine and the electrical power to the glow plug can be terminated.

Initially, the heating element of the glow plug was a coiled resistance wire such as disclosed by Dorner in U.S. Pat. No. 1,957,762. However, the resistance wire would become brittle after a relatively short period of time and break off. Therefore these glow plugs had to be replaced frequently. Additionally the loose pieces of wire in the cylinders often became trapped between the piston and the cylinder wall and scored the cylinder walls causing permanent damage to the engine. To overcome these problems the prior art teaches enclosing the heater element in a cylindrical metal shield as taught by Kauhl et al in U.S. Pat. No. 4,200,077, Steinke in U.S. pat. No. 4,252,091, or Mann in U.S. Pat. No. 4,281,451. Although these later glow plugs have overcome the problems encountered with the bare wire glow plugs, their thermal response time is significantly increased. For example, there is currently about a 30 second delay from the time the glow plug is energized before the engine can be started. Additionally, thermal run-away of the heater element can melt the protective metal shield. Often the melted protective shield becomes so distorted that it is necessary to tear down the engine to remove the failed glow plug.

The prior art also discloses replacing the coiled heater wire with a spirally wound flat tape like heating element such as disclosed by Knowles in U.S. Pat. No. 4,297,785 or by Glauner et al in U.S. Pat. No. 4,211,204 in which the spiral heating element is enclosed in a tubular shield. In contrast to the helical or spiral wound heating elements, White in U.S. Pat. No. 2,178,659 discloses the use of a thin wall cylindrical heating element made from a resistance metal. The disadvantage of this type of glow plug is that it requires a relatively large electrical current to heat the thin walled cylinder to its operating temperature and because of its mass has a relatively long thermal response time. An alternate version of this type of electric heater is the gas igniter disclosed by Peri in U.S. Pat. No. 3,842,319 in which the metal cylinder is replaced by a silicon carbide cylinder. Closely spaced slots are cut through the silicon carbide cylinder to form a double helix to increase the resistance of the silicon carbide heating element.

The invention is a novel glow plug having increased resistance to the harsh environment found in the cylinder of an internal combustion engine, lower power requirements, and a thermal response time in the order of seconds rather the tens of seconds characteristic of the prior art glow plugs.

SUMMARY OF THE INVENTION

The invention is a glow plug for use in diesel engines having a conductive film heating element disposed on the surface of a dielectric substrate. The dielectric substrate is supported at one end from a metal base which is in electrical contact with one end of the heater element and functions as a first electrode. A second electrode passing concentrically through the bore in the base electrically contacts the other end of the heater element. Insulator means resiliently support the second electrode within the base and produces a force holding the dielectric substrate against the housing.

The advantages of the conductive film heater element is its fast response from ambient to operating temperature, immunity to the harsh environment such as found inside the cylinders of a Diesel engine, significantly lower electrical power requirements and a catalytic action supporting the combustion process.

These and other advantages of the conductive film heater will become more apparent from a reading of the detailed description in conjunction with the drawings.

BRIEF DESCRIPTION OF THE FIGURES

FIG. 6 is a partial cross sectional view of a second alternate embodiment of the heater member.

FIG. 10 is a cross-sectional side view of the planar heater member.

FIG. 11 is a plan view of an alternate configuration of the planar heater member.

DETAILED DESCRIPTION OF THE INVENTION

The glow plug will first be described with reference to the embodiment shown on FIGS. 1 and 2.

Figure 1:
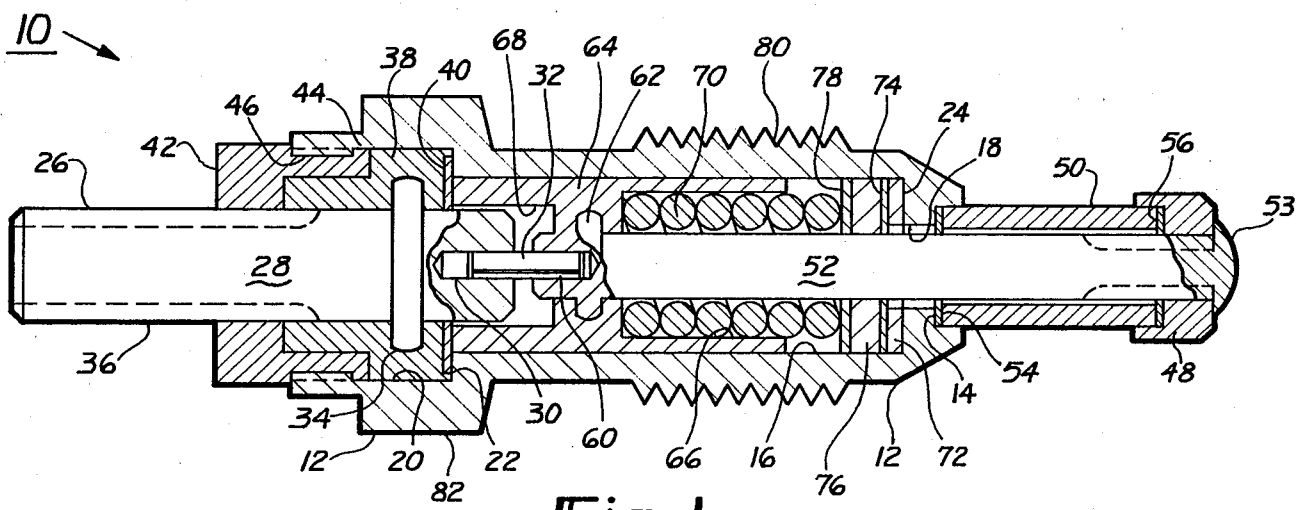
FIG. 1 is a cross sectional side view of a glow plug embodying the conductive film heater member.
Figure 2:
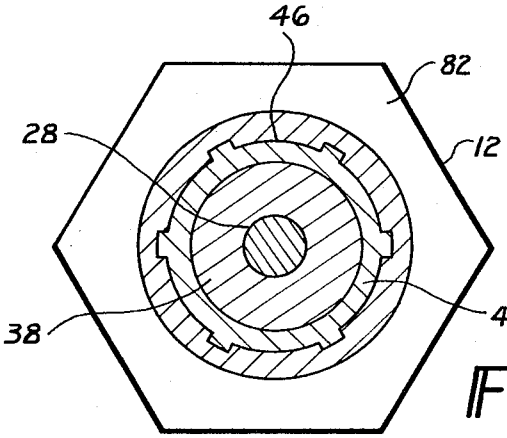
FIG. 2 is a cross sectional end view of the glow plug of FIG. 1.

Referring to FIGS. 1 and 2 there is shown a cross-sectional side view and a cross-sectional end view of a glow plug 10.

The glow plug comprises a generally cylindrical steel body or base member 12 having a recessed shoulder 14 at one end thereof for receiving one end of a cylindrical heater member 50. The base member 12 has a central cylindrical bore 16, a pass through bore 18, and a stud bore 20. A stud seat 22 is formed at the interface between the central bore 16 and stud bore 20 and a spring seat 24 is formed at the interface between pass-through bore 18 and central bore 16.

A stud assembly 26 is disposed in the stud bore 20 and abuts the stud seat 22. The stud assembly 26 comprises a stud pin 28 having an axial bore 30 for receiving a berillium copper spiral spring pin 32, and a radial flange 34. The end of the stud pin opposite said axial bore 30 protrudes external to the base member 12 and has a threaded portion 36 for the attachment of an electrical connector. A stud block 38 axially supports the stud pin 28 in stud bore 20 and electrically insulates the stud pin 28 from the base member 12. The stud block 38 is made from an engineering thermoplastic such as polyphenylene sulfide available from Phillips Chemical Company under the tradename Ryton® R-4, which is molded about the stud pin 28. Radial flange 34 is encapsulated in the molded stud block 36 and prevents axial movement between these two elements.

A silastic washer 40 is disposed between the internal face of the stud block 38 and the stud seat 22. The stud assembly 26 is secured in the end of the base member 12 by injection molding an end cap 42 over the end thereof. Axial movement of the stud assembly 26 and end cap 42 relative to base member 12 is prevented by a cylindrical recess 44 intermediate the stud seat 22 and the end of the base member 12. Rotational movement of the stud assembly 26 and the end cap 42, relative to the base member 12 is prevented by a splined section 46 of bore 20 between cylindrical recess 44 and the end of the base member 12 as more clearly illustrated in FIG. 2.

A cap 48 attached to an axial electrode 52 captivates the end of the heater member 50 opposite recess shoulder 14. A first plated contact washer 54 is disposed between the recessed shoulder 14 and the adjacent end of the heating member 50 and provides for electrical contact between one end of the heating member 50 and the base member 12. A second plated contact washer 56 is disposed between the cap 48 and the other end of the heater member 50 and provides for electrical contact therebetween. The contact washers 54 and 56 may be beveled washers but preferably have a domed configuration as illustrated in the cross sectional view of FIG. 3 having the dome 58 abutting the heating element 50. These washers may be plated with gold, silver, platinum, palladium or other noble metal or noble metal alloy used in electrical contact applications.

The end cap 48 is threadably received on the end of axial electrode 52. The protruding end 53 of the axial electrode 52 is then orbit rivited to end cap 48 as shown to permanently join these two members. The opposite end of axial electrode 52 has a radial flange 62 and an axial bore 60 receiving the other end of spiral spring pin 32. A cylindrical guide 64 is molded about the end of axial electrode 52 and encapsulates radial flange 62. The cylindrical guide is slidably disposed in central bore 16 and electrically insulates axial electrode 52 from the base member 12. The cylindrical guide 64 includes a cup shaped spring seat 66 receiving one end of a resilient member, such as coil spring 70. The cylindrical guide also has a second cup shaped portion 68 which circumscribes the protruding portion of stud pin 28 and abuts silicone washer 40. The cylindrical guide 64 may be made from an engineering thermoplastic such as Ryton® R-4.

The opposite end of coil spring 70 abuts against spring seat 24 of base member 12 via a series of washers and produces a force acting through axial electrode 52 and cap 48 urging heater member 50 against recessed seat 14. This force, preferably in the range from 50 to 100 pounds, insures good electrical contact between the plated contact washers 54 and 56 and the heater member 50 and allows for thermal expansion of the heater element.

A series of washer elements 72 through 78 are disposed between spring seat 24 and coil spring 70 to provide electrical and thermal insulation between coil spring 70 and the base member 12. Washer 72 is made from steel and provides the primary structural support for the series of washers. Washer 76 is made from aluminum silicate which is commercially available under the trade name Lava® from the technical Ceramics Division of the 3M Corporation of Chattanooga, Tenn. The aluminum silicate washer 76 provides the primary electrical and thermal insulation between the axial electrode 52, the spring 36 and the base member 12. Washer 74 disposed between steel washer 72 and the aluminum silicate washer 76 is made from a high temperature silastic material such as GP-590 commercially available from Dow Corning of Midland, Mich. Silastic washer 74 prevents abrasion of the aluminum silicate washer 76 by the steel washer 72. Washer 78 is made from a phenolic material to prevent gouging of the aluminum silicate washer 76 by the end of coil spring 70. The washers 74, 76 and 78 support axial electrode 52 concentrically in pass-through bore 18 and prevent electrical contact between axial electrode 52 and base member 12.

The base member further includes an externally threaded section 80 for mounting the glow plug in the engine's head and a hexagonally shaped portion 82 to facilitate the threading of the glow plug into the engine's head.

Figure 4:
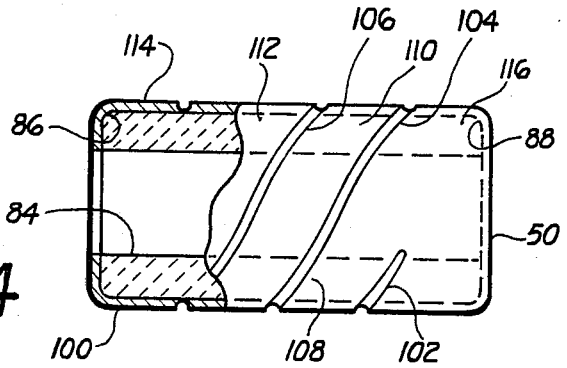
FIG. 4 is a partial cross sectional view of one embodiment of the heater member.

The details of the heating member 50 will be discussed relative to the alternate embodiments illustrated on FIGS. 4, 5 and 6. Referring first to FIG. 4 the heater member 50 comprises a cylindrical ceramic substrate 84, such as an alumina or quartz cylinder approximately 1.0 centimeters long and 0.5 centimeters in diameter. The edges 86 and 88 of the ceramic cylinder 84 are finely ground to produce a radius blending the external surfaces of the cylinder with the end surfaces. A metal or cermet film 100, between 0.1 and 10.0 microns thick, is deposited over the external surface of the cylindrical and end surfaces. The film 100 may be deposited on the surfaces of the cylinder using any known technique, such as vapor deposition, vacuum deposition, sputtering, plasma spraying or chemical decomposition. For glow plug applications, the film is made from a noble metal or cermet containing a noble metal, preferably of the platinum family such as platinum, rhodium, palladuim, iridium or alloys thereof.

The prototype heater members were made by brush coating the external surface of the cylinder and the ends with a thin coat of platinum ink solution Number 6082 commercially available from Engelhard Industries Division, Engelhard Corporation, East Newark, N.J. The coated cylinder was then fired at a temperature of 1000° C. for 10 to 20 minutes to produce a platinum coating on the external cylindrical surface and ends approximately 10 microns thick. Helix grooves, such as grooves 102, 104 and 106 were then cut through the platinum film 100 in the central portion of the cylindrical surface to form a plurality of helix shaped heater elements such as heater elements 108, 110, and 112. The portions of the platinum film 114 and 116 disposed over the opposite ends of the substrates cylindrical and end surfaces connect the heater elements 108 through 112 in parallel. In the preferred embodiment the resistance of the parallel heater elements is between 2.0 to 0.5 ohms.

Figure 5:
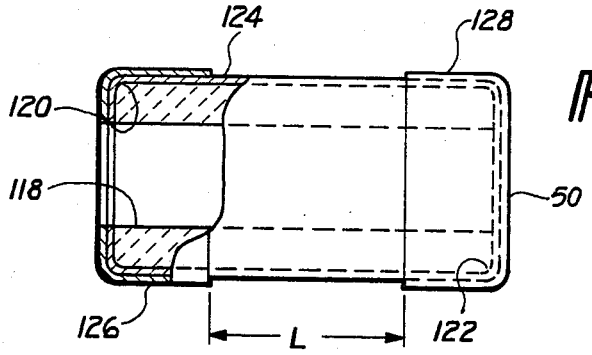
FIG. 5 is a partial cross sectional view of an alternate embodiment of the heater member.

An alternate embodiment of the thin film heater member 50 is illustrated in FIG. 5. Referring to FIG. 5 the heater member 50 comprises a cylindrical ceramic substrate 118 which may be identical to the cylindrical ceramic substrate 84 discussed relative to FIG. 4. In a like manner the external edges 120 and 122 of the cylindrical substrate 118 are finely ground to produce a radius blending the external surface of the cylindrical surface with the end surfaces.

A first conductive film 124, such as a platinum film 0.1 to 10.0 microns thick is deposited on the external cylindrical and end surfaces of the substrate 118 as shown. The end portions of the cylindrical surface and the ends of the cylinders are then overlayed with a thicker metal film such as films 126 and 128 forming low resistance electrodes at the opposite ends of the heater member 50. Preferably the metal films are noble metals of the platinum family as previously described.

A heating element of length "L" is formed between low resistance electrodes 126 and 128 having a resistance between 2.0 and 0.5 ohms. It is obvious that low resistance electrodes, such as electrodes 126 and 128, if desired, may also be added to the configuration of the heater member 50 illustrated in FIG. 4.

A modification of the embodiment illustrated in FIG. 5 is shown on FIG. 6. In this embodiment the first conductive film 124 is desposited on the external cylindrical and end surfaces of the substrate 118 as shown on FIG. 5. A band of a second metal having a width "l" is then overlayed over the first conductive film 124 and alloyed therewith to form a high resistance alloy band 132 circumscribing the central region of the cylindrical substrate. The second metal is selected so that the formed alloy has a higher resistance than the resistance of the conductive film 124. As in previous embodiments, the resistance of the alloy band is between 2.0 and 0.5 ohms.

The heating elements are preferably made from noble metals, metal alloys or cermets continuing at least one member of the platinum family because of their excellent resistance to corrosion in the harsh environment inside the engine's cylinders. Further heating elements of the platinum family further appear to have a catalytic action enhancing the ignition of the fuel similar to that disclosed by Oshima et al in U.S. Pat. No. 4,345,555. In conducted tests using glow plugs with platinum heating elements, ignition was found to take place at lower heater element temperatures than with conventional glow plugs. Although the primary tests have been conducted using platinum heater elements, other metals of the platinum family, such as iridium, palladium, and rhodium and alloys thereof having higher melting temperatures and potentially increased catalytic action may be used in place of platinum.

A further advantage of the platinum family heater elements is that they have a positive coefficient of resistance with temperature. Therefore by appropriate selection of the heater element resistance and configuration, the heater element can be made self limiting eliminating sophisticated electronic-control to prevent thermal-run-away and heater burn out.

Figure 3:
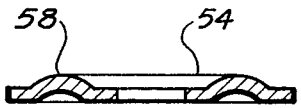
FIG. 3 is a cross sectional view of the contact washers.
Figure 7:
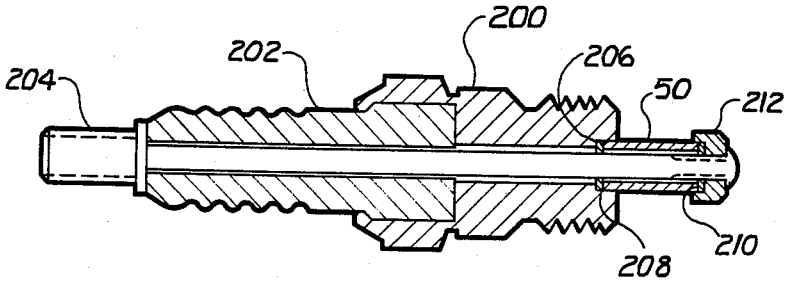
FIG. 7 is a cross-section view of an alternate embodiment of the glow plug having a cylindrical heater member.

Referring now to FIG. 7 there is shown an alternate embodiment of a glow plug using a conventional metal spark plug base member 200 and ceramic insulator 202. The axial electrode 204 is fixedly attached to the ceramic insulator 202 and has a portion protruding external to end of the base member 202. A cylindrical film heater member 50, such as discussed relative to FIG. 4, 5 or 6 is slidably received over the axial electrode 204 and is seated in a recess 206 machined in the base member 200. Noble metal plated contact washers 208 and 210 such as described relative to FIGS. 1 through 3 are disposed at either end of the heater members 50 and resiliently support the heater member 50 between the base member 200 and a nut 212 threaded on the end of the axial electrode 202. The end of the axial electrode 202 is orbit riveted to the nut 212 as shown, to complete the assembly. The recess 206 concentrically supports the cylindrical heater member 50 and the plated contact washer 208 about the axial electrode 204 and prevents electrical contact between these elements.

Figure 8:
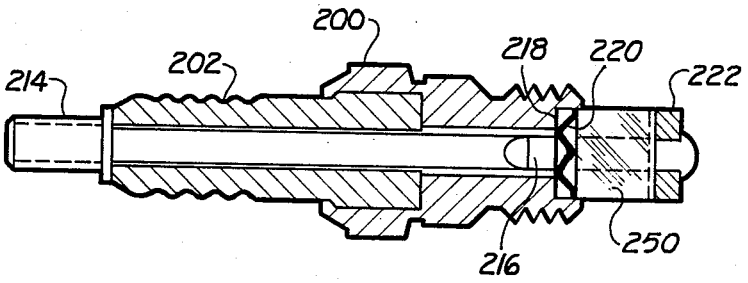
FIG. 8 is a cross-sectional view of a glow plug having a planar heater member.
Figure 9:
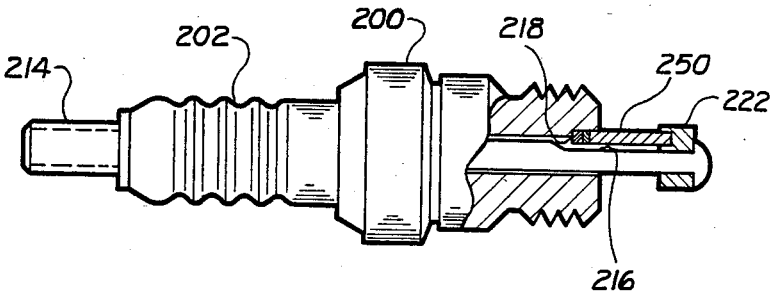
FIG. 9 is a partial cross-sectional view of the glow plug of FIG. 7 rotated 90°.

Although the cylindrical configuration of the heater member 50 is preferred for structural reasons, the heater member 50 may be embodied in any desired configuration. Referring to FIGS. 8 and 9 there is shown a glow plug similar to the embodiment of FIG. 7 in which the heater member 50 has a planar configuration rather than the preferred cylindrical configuration. In this embodiment, the axial electrode 214 has a flattened portion 216 proximate the end protruding from the base member 200 to provide clearance for a planar heating member 250. The base member 200 has a rectangular recess 218 for receiving one end of the heater member 250 and a noble metal plated wavy spring member 220 disposed at the bottom of recess 218. A noble metal plated channel member 222 is slidably disposed over the axial electrode 214 and captivates the opposite edge of the planar heater member 250. The channel member 222 and heater element 250 are then depressed against wavy spring member 220 and the protruding end of the axial shaft 214 orbit riveted to the channel member. The force provided by the wavy spring member 220 holds the heater element 250 against channel member 222 while permitting thermal expansion of the heater member 250.

The details of the planar heater member 250 are illustrated on FIG. 10 which is an enlarged cross-sectional view having the same orientation shown in FIG. 9. The heater member 250 comprises a planar rectangular ceramic substrate 252. The edges 254 through 260 are finely ground to produce a radius blending the planar surfaces 262 and 264 with the end surfaces 266 and 268. The planar surfaces and end surfaces 262 through 268 are overlayed with a conductive film to form a planar surface heating elements 270 on the opposite sides of the substrate 252. As with the cylindrical embodiments, the heating elements 270 are preferably a noble metal of the platinum family or a cermet containing a member of the platinum family. Thicker contact films 272 and 274 may be added over the end surfaces 266 and 268 and a predetermined distance from either end as shown to provide extra thickness in areas of electrical contact with wavy washer 220 and channel member 222. If desired the resistance of the heater element 270 may be increased by cutting grooves, such as grooves 278 and 280 through the heater elements 270 as shown in FIG. 11. The grooves 278 and 280 produce a serpentine conductive path increasing the length between the thicker films 272 and 274. These grooves also increase the length to width aspect ratio of the heater elements 270 and thereby increase their resistance.

Figure 12:
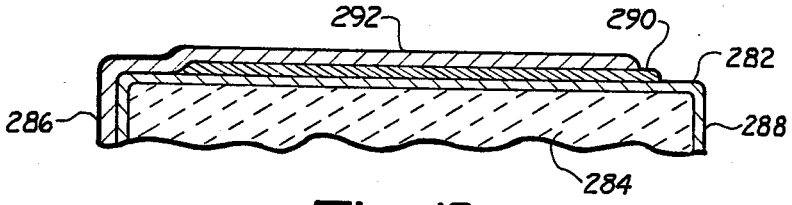
FIG. 12 is a partial cross-section of an alternate structural arrangement of the heater member.

To achieve the desired catalytic action of the glow plug, it is not necessary that the heater element itself, be made from a member of the platinum family. Referring to FIG. 12, a metal film heater element 282 comprising a film made from a resistive material, such as nichrome, may be disposed directly over the surface of the substrate 284. The central area of the heater element 282 between the contact ends 286 and 288 is overlayed with a thin layer 290 of a dielectric material, such as alumina or spinel dioxide ($SiO_2$). The dielectric layer 290 is then overlayed with a thin metal film 292 of the platinum family. The platinum family film 292 overlaps the heater element 282 at one of the contact ends, such as end 286, to electrically ground film 292 and prevent the build up of static charges. Alternatively the dielectric layer 290 may be made from a semiconductor material capable of bleeding static charges developed on the film 290 directly to heater element 282. It is obvious that the structural arrangement of the heater member illustrated in FIG. 12 is applicable to both the cylindrical and planar configurations of the heater member.

Figure 13:
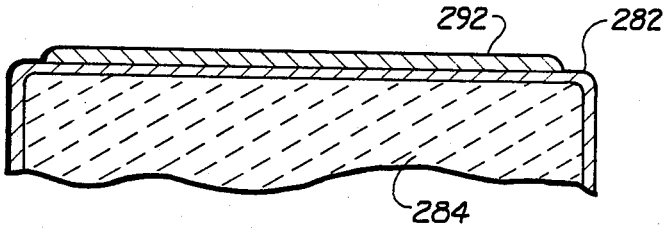
FIG. 13 is a cross-sectional side view of an alternate embodiment of FIG. 12.

An alternate embodiment of the heater member 50 illustrated in FIG. 12 is shown in FIG. 13. In this embodiment the dielectric layer 290 is omitted and the platinum family metal film 290 is deposited directly over the resistive heater element 282. The interface between the film 290 and the resistive heater element 282 is partially alloyed such that the exposed external surface of the heater member is primarily that of the platinum family metal overlay.

Figure 14:
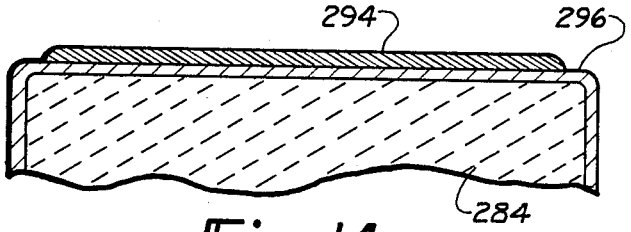
FIG. 14 is a cross-sectional side view of an alternate embodiment of the heater member having a porous ceramic overlay.

For added protection of the heater element from the harsh environment inside of the engine's cylinder, a porous ceramic layer of alumina, spinel or other ceramic layer, such as layer 294, disposed over the surface of the heater element 296 as shown in FIG. 14. This porous layer may be used in connection with any of the heater members previously described.

Figure 15:
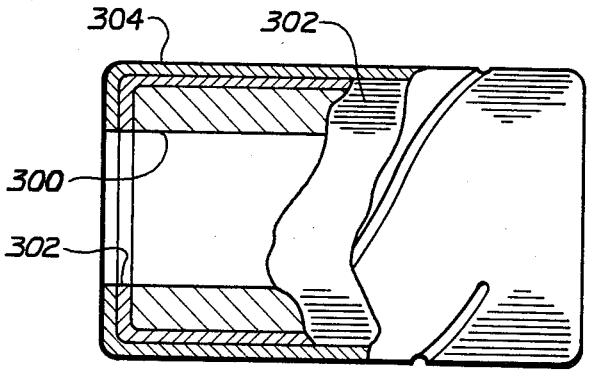
FIG. 15 is a cross-sectional view of a heater member having a metal substrate.

For added structural properties the heater member 50 may have a metal substrate as shown in the alternate embodiment illustrated in FIG. 15. In this embodiment, the cylindrical substrate 300 is a metal cylinder rather than a ceramic material. Disposed over the surface of the metal cylinder 300 is dielectric layer 302. Dielectric layer 302 may be a chemically formed surface oxide, or a deposited layer such as porcelain alumina or spinel. The conductive film 304 is then deposited over the dielectric layer as previously described.

Figure 16:
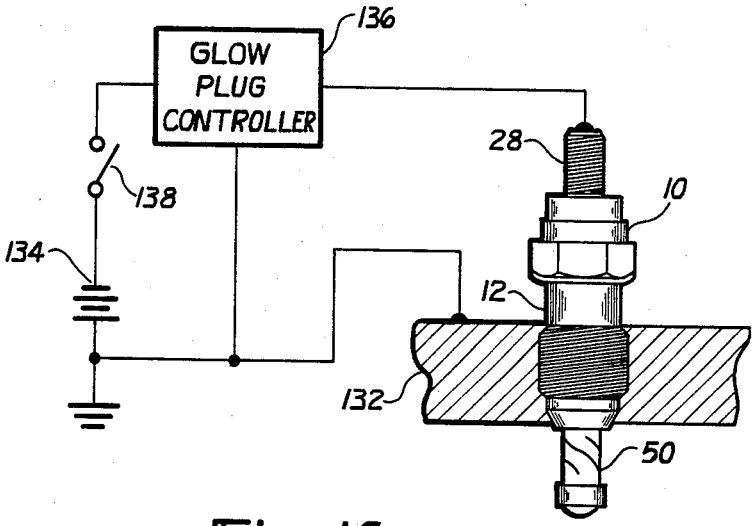
FIG. 16 is an electrical diagram showing the metal film heater as a glow plug in a Diesel engine.

Referring now to FIG. 16, there is shown a metal film glow plug 10 mounted to the cylinder head 132 of a Diesel engine. In a conventional manner one terminal of a source of electrical power, such as battery 134, is electrically grounded to the engine. The base member 12 is threadably received in the cylinder head 132 and provides a ground potential at one end of the heater member 50 as previously described.

The other end of the heater member 50 electrically connected to stud pin 28 is connected to the output of a Glow Plug Controller 136. The Glow Plug Controller 136 receives electrical power from the other terminal of the source of electrical power and is operative to transmit the electrical power from the battery to the glow plug in response to an external command such as by closing switch 138 prior to starting the engine. Conventionally switch 138 is a separate switch activated by the operator prior to cranking the engine. However, due to the fast response time, (one to three seconds) of the conductive film glow plug, switch 138 may be the engine's ignition switch.

The Glow Plug Controller 136 may be of any conventional design, operative to turn off the electrical power to the glow plug after a predetermined period of time, or after the engine has started and reached a self sustaining mode of operation as indicated by the electrical output of the engine's alternator, engine temperature, the oil pressure, or a combination of the above. The Glow Plug Controller 136 may include a voltage regulator to limit the maximum voltage applied to the heater element. After the electrical power to the glow plug has been terminated, the glow plug will be maintained at a temperature sufficient to sustain the operation of the engine by the heat generated in the cylinder from the combustion of the air/fuel mixture.

The advantages of the conductive film heater described above are as follows:

1. The noble metal heater elements are resistive to corrosive atmospheres, such as found in the cylinders of a Diesel engine and do not corrode at an operating temperature up to 1700° C.
2. The metal film heater elements, due to their small mass, have a very fast thermal response time. The temperature of the heater elements will increase from an ambient temperature to an operating temperature between 900° C. and 1500° C. in 2 to 3 seconds.
3. The watt density of the metal film heater elements exceeds that of bulk materials giving rise to significantly lower current requirements, nominally in the range from 2–3 amps at operating temperatures.
4. The thin films have a positive coeficient of resistance giving rise to potential current limiting designs.
5. Noble metal heaters of the platinum family exhibit catalytic action enhancing the ignition of the fuel.
6. The metal film heater elements may be laser or mechanically trimmed for unit reproducibility.
7. The metal film heater member may be made using current available technology.
8. The metal film heaters are potentially less costly than the heaters using wires or spirally wound elements.

It is recognized that structure of heater may be changed or that other metals may be used as the heater elements without departing from the spirit of the invention as described herein and set forth in the appended claims.

We claim:

1. A glow plug for a diesel engine comprising:

a metal body having a cylindrical bore;

an electrode concentrically disposed in said cylindrical bore and insulated therefrom;

a heater member having a cylindrical substrate circumscribing said electrode and a heater element comprising a transition metal film disposed on the surface of said cylindrical substrate and a metal film overlay disposed in said transition metal film a predetermined distance from each end of said cylindrical substrate, said cylindrical substrate being supported at one end by said metal body with said metal overlay in electrical contact with said metal body; and a cap connected to the end of said electrode fixedly captivating the other end of the heater member and providing electrical contact between the metal overlay at the adjacent end of said cylindrical substrate and said electrode.

2. The glow plug of claim 1 further including conductive resilient means disposed between said heating member and said body and said cap to allow for thermal expansion of said heating member.

3. The glow plug of claim 1 wherein said conductive film heater element is a transition metal film.

4. The glow plug of claim 1 wherein said conductive film heater element is a transition metal film selected from the platinum family comprising platinum, palladium, iridium and rhodium.

5. The glow plug of claim 1 wherein said conductive film heater element is a metal alloy film containing at least one metal selected from the platinum family comprising platinum, palladium, iridium and rhodium.

6. The glow plug of claim 1 wherein said conductive film is a cermet containing at least one metal selected from the platinum family comprising platinum, palladium, iridium and rhodium.

7. A heater member for a glow plug having a body and an axial electrode, said heater member comprising:

a substrate supported between said body and said axial electrode;

a conductive surface film heater element disposed on the surface of said substrate; and a metal film overlay disposed over said heater element a predetermined distance from each end of said heater element, said metal film electrically connected one end of said heater element to said body and the other end of the heater element to said axial electrode.

8. The heater member of claim 7 wherein said conductive surface film is a conductive cermet film substantially covering at least one surface of said substrate.

9. The heater member of claim 7 wherein said conductive surface film heater element is a metal film substantially covering at least one surface of said substrate.

10. The heater member of claim 9 wherein said metal film is a transition metal.

11. The heater member of claim 10 wherein said transition metal is selected from a member of the platinum family comprising platinum, palladium, iridium and rhodium.

12. The heater member of claims 9, 10 wherein said substrate is a cylindrical substrate.

13. The heater member of claim 12 wherein said cylindrical substrate is a ceramic cylinder.

14. A glow plug comprising:

a cylindrical substrate;

a conductive transition metal film heater element disposed on at least the external surface of said cylindrical substrate;

a metal film overlay disposed on the surface of said heater element a predetermined distance from each end of said cylindrical substrate;

a cylindrical metal base concentrically supporting one end of said cylindrical substrate and in electrical contact with the adjacent metal film overlay;

an axial electrode concentrically passing through said cylindrical base and substrate, said axial electrode supporting the opposite end of said substrate and in electrical contact with the metal film overlay at the opposite end of said cylindrical substrate; and insulator means concentrically supporting said axial electrode to said base.

15. The glow plug of claim 14 wherein said conductive film heater element is a cermet film heater element containing at least one metal selected from the platinum family comprising platinum, palladium, iridium and rhodium.

16. The glow plug of claim 15 wherein said cermet heater element has a resistance between 2.0 and 0.5 ohms.

17. The glow plug of claim 14 wherein said cylindrical substrate is a ceramic cylinder.

18. The glow plug of claim 17 wherein said ceramic cylinder is an alumina cylinder.

19. The glow plug of claim 17 wherein said ceramic cylinder is a quartz cylinder.

20. The glow plug of claim 17 wherein said conductive film heater element is a cermet film heater element containing at least one metal selected from the platinum family comprising platinum, palladium, iridium and rhodium.

21. The glow plug of claim 14 wherein said transition metal heater element is a metal film heater element selected from a member of the platinum family comprising platinum, iridium, palladium and rhodium.

22. The glow plug of claim 21 wherein said transition metal film heater element is a platinum film.

23. The glow plug of claim 21 wherein said transition metal heater element is a metal alloy heater element containing at least one transition metal.

24. The glow plug of claims 21, 22 or 23 wherein said metal film heater element has a resistance between 2.0 and 0.5 ohms.

25. A glow plug having a metal base and an axial electrode passing through said base and electrically insulated therefrom, a heater member electrically connected between said base and axial electrode characterized by:

a heater member substrate having at least one end structurally supported by said base;

a conductive surface film heater element disposed on at least one surface of said substrate having one end in electrical contact with said base and the other end in electrical contact with said axial electrode; and a metal film overlay disposed on said conductive surface film heater element a predetermined distance from each end of said substrate.

26. The glow plug of claim 25 wherein said conductive film heater element is a cermet film.

27. The glow plug of claim 26 wherein said cermet film includes at least one transition metal selected from the platinum family comprising platinum, palladium, iridium and rhoduim.

28. The glow plug of claim 26 further including a thin film of a transition metal selected from the platinum family comprising platinum, palladium, iridium and rhodium deposited over the surface of said cermet film.

29. The glow plug of claims 26, 27 or 28 wherein said substrate is a cylinder disposed concentric with said axial electrode.

30. The glow plug of claim 29 wherein said cylinder is a ceramic cylinder.

31. The glow plug of claim 25 wherein said conductive film heater element is a metal film substantially covering said at least one surface of the substrate.

32. The glow plug of claim 31 wherein said metal film is a transition metal film selected from the platinum family comprising platinum, palladium, iridium and rhodium.

33. The glow plug of claim 31 wherein said metal film is an alloy containing at least one transition metal selective from the platinum family comprising platinum, palladium, iridium and rhodium.

34. The glow plug of claims 21, 32 or 33 wherein said substrate is a cylinder circumscribing said axial electrode and said conductive film is disposed on the external surface of said cylinder.

35. The glow plug of claim 34 wherein said conductive film heater element is at least one continuous conductive film helically disposed on the external surface of said cylinder.

36. The glow plug of claim 35 wherein said at least one continuous conductive film is a plurality of conductive films helically disposed on the external surface of said cylinder.

37. The glow plug of claim 34 wherein said cylindrical substrate is a ceramic cylinder.

38. The glow plug of claim 37 wherein said ceramic cylinder is an alumina cylinder.

39. The glow plug of claim 37 wherein said ceramic cylinder is a quartz cylinder.

* * * * *